US008439359B2

(12) United States Patent
Stites

(10) Patent No.: US 8,439,359 B2
(45) Date of Patent: May 14, 2013

(54) SHUFFLEBOARD PLAYFIELD ASSEMBLY

(76) Inventor: Kelye Stites, Colleyville, TX (US)

( * ) Notice: Subject to any disclaimer, the term of this patent is extended or adjusted under 35 U.S.C. 154(b) by 372 days.

(21) Appl. No.: 12/821,566

(22) Filed: Jun. 23, 2010

(65) Prior Publication Data

US 2011/0316228 A1 Dec. 29, 2011

(51) Int. Cl.
*A63F 7/00* (2006.01)

(52) U.S. Cl.
USPC ..... 273/126 R; 273/126 A

(58) Field of Classification Search ..... 273/108, 273/118 R, 123 R, 125 R, 126, 126 A, 126 R, 273/127 B, 283; 108/19, 35; 473/3, 107, 473/116, 496
See application file for complete search history.

(56) References Cited

U.S. PATENT DOCUMENTS

| | | | | |
|---|---|---|---|---|
| 420,959 | A | 2/1890 | Rand | |
| 1,360,661 | A | 11/1920 | Malone | |
| 1,636,535 | A | 7/1927 | Sherry | |
| 1,962,899 | A | 6/1934 | Hagy | |
| 1,980,105 | A | 11/1934 | Staff | |
| 2,256,175 | A | 9/1941 | Schmidt | |
| 2,260,716 | A | 10/1941 | Kotler | |
| 2,493,620 | A | 1/1950 | Cusano | |
| 2,722,421 | A | 11/1955 | Nicolaus | |
| 3,572,717 | A | 3/1971 | Anguella | |
| 3,586,325 | A | 6/1971 | Lorber | |
| 3,595,574 | A | 7/1971 | Saffer | |
| 3,703,288 | A | 11/1972 | Vogel et al. | |
| 3,783,799 | A * | 1/1974 | Dupuis | 108/19 |
| 3,825,264 | A * | 7/1974 | Dockum | 273/126 R |
| 3,837,298 | A | 9/1974 | Leonhart | |
| 4,283,049 | A | 8/1981 | Karlin et al. | |
| 4,762,321 | A * | 8/1988 | Chang | 473/496 |
| 4,872,687 | A | 10/1989 | Dooley | |
| 4,995,611 | A * | 2/1991 | Goldthorpe | 273/123 R |
| 5,171,013 | A | 12/1992 | Dooley | |
| 5,401,217 | A | 3/1995 | Rodriguez-Ferre | |
| 5,556,095 | A | 9/1996 | Stites | |
| 5,575,718 | A | 11/1996 | Simmons | |
| 5,702,308 | A | 12/1997 | Alexander, Jr. | |
| 5,865,681 | A | 2/1999 | Tudek et al. | |
| 6,002,280 | A * | 12/1999 | Robbins et al. | 327/156 |
| 6,929,557 | B2 | 8/2005 | Chou | |

* cited by examiner

*Primary Examiner* — Nini Legesse
(74) *Attorney, Agent, or Firm* — Husch Blackwell LLP

(57) ABSTRACT

The present invention is directed to a two-piece shuffleboard playfield having two rectangular planar members forming the overall playfield, two bracket members and adjustment members. The two elongated planar playfield members are attached to each other with the bracket members. Each bracket member is mounted to the lower surface of one of the elongated planar members at the point of joinder of the two elongated playfield members. When the playfield members are placed in abutting relationship to each other, the bracket members are likewise placed adjacent to each other for securely attaching the same to each other with a plurality of fastener members. An adjustment bolt is position at each respective end portion of each bracket member for leveling the top surface of the elongated planar members at their point of joinder. Each end portion of one rectangular planar member adjacent the point of joinder or joint edge can be moved up and down with respect to the other end portions of the rectangular planar members by adjusting the adjustment members. The adjustment bolts are used to raise one corner of each of the elongated playfield members independently of each other at the point of joinder.

6 Claims, 4 Drawing Sheets

SHUFFLEBOARD PLAYFIELD ASSEMBLY

BACKGROUND OF THE INVENTION

This invention relates generally to a game board or playfield for the game of shuffleboard and, more particularly, to a shuffleboard playfield or game board wherein the playfield is cut in half for ease of mobility and includes cooperating brackets located at the joinder intersection of the two halves of the playfield for easy assembly and a leveling mechanism for leveling the playfield at the point of joinder.

The shuffleboard game employs disks or pucks which are slidably propelled on a floor surface, game board or playfield from one end of the playfield to the other. The playfield is typically made of wood and incorporated into a heavy table like structure of considerable length with a relatively massive perimeter frame to accommodate the playing disks sliding off of the playfield anywhere along its length. The disks are propelled by a player in a sliding motion on the flat playing surface to impart a desired momentum to the disk so as to score points based upon the proximity of the disk trajectory terminus to a target location. Because of the sliding motion of the game, a flat level playfield throughout its entire length is imperative both to scoring points and to give full credit to the skill of the players.

Despite their basic appeal, shuffleboard games have generally been manufactured for commercial use in commercial establishments and as such, they are heavy in weight, relatively long in length, cumbersome to move, and generally immovable once positioned in a particular location. As a result, shuffleboard games are not widely used in non-commercial locations such as residential homes, senior citizen centers, church activity centers, office locations and similar locations due to space availability. While conventional shuffleboards are suitable for the purposes just described, the length of the playfield or game board is generally too long to be carried through narrow passageways, around corners, and up and down stairs and, as such, restricts the installation process such as in basements and upper floor locations.

The playfield or playing surface of a shuffleboard game is also impacted or affected by changes in humidity which can causes the wooden playfield to warp thereby making the playing surface upon which the disks or pucks slide uneven or not level. This means that the disks will not slide or travel true to form and will impact the play of the game. To counteract this warping problem, various types of leveling mechanisms have been proposed and are known in the art. This leveling problem is even more critical if the playing surface or playfield is cut in half as in the present invention.

U.S. Pat. No. 3,572,717 issued to Anguella discloses a miniature and portable shuffleboard game which comprises two sections capable of being quickly assembled to form a miniature shuffleboard table which can be easily assembled and disassembled for play, storage and for easy transportation. Corresponding attachment means are associated with each of the table sections for aligning and connecting the sections together in the assembled position. Pivotal legs are likewise associated with each table section for supporting each section in the assembled position. A pair of threaded members extend downwardly from one end of one of the table sections and are cooperatively received into corresponding holes associated with the other table section and are utilized in connecting the two sections together. Overlapping extension portions associated with each table section accounts for the aligning of the top surface of the two sections when joined together. No additional leveling mechanism is provided.

U.S. Pat. No. 2,493,620 issued to Cusano discloses a shuffled board table having a leveling mechanism which includes a pair of brackets fixedly secured by screws to the board adjacent the outer portions thereof and a third bracket positioned centrally therebetween. A rigid beam is secured to the end brackets and a bolt extends through a central opening in the beam for mating with the third centrally located bracket. Movement of a pair of nuts associated with a bolt which mates with the central bracket allows the center portion of the table to be moved up or down to adjust for warping of the table at its center due to humidity or other atmospheric conditions. This adjustment mechanism only corrects for warping of a one-piece playing surface at the center of the table as shown in FIGS. 5 and 6 and does not function to level two half sections of a playing surface at or adjacent to the point of joinder where the half sections are connected together.

U.S. Pat. No. 5,865,681 issued to Tudek discloses a ball game table vaguely similar to shuffleboard wherein the playing surface is completely covered with a fabric such as grass carpeting along its longitudinal dimension. More particularly, the playing board is cut in half and a nut, bolt and washer assembly is used for securing two cross members together thereby resulting in joining the two halves of the game board. It further discloses the use of adjustment levelers which are screwed into cross members at a plurality of locations along the length of the game board. These cross member levelers are described as being a short piece of round pipe filled with cement after an all-threaded hexagon head bolt is centered and extended within the pipe to be hand screwed into the cross members at weight bearing points to level the table. None of the adjustment levelers are positioned at or adjacent to the joint intersection where the two halves of the board are connected together. In addition, these adjustment levelers do not adjust the height level of the carpet which is layered on the top surface of the game board playing surface.

It is therefore desirable to provide an improved standard full length shuffleboard playfield wherein the shuffleboard playfield is cut in half and includes two elongated planar members which can be easily assembled on location and adjusted at the point of joinder to yield a level flat playing surface at the joinder point.

Specific advantages and features of the present invention will be apparent from the attached drawings and description of an illustrative embodiment of the invention.

BRIEF SUMMARY OF THE INVENTION

The present invention overcomes many of the shortcomings and limitations of the prior art devices discussed above and teaches the construction and operation of several embodiments of a shuffleboard playfield adapted for use with a shuffleboard game of different sizes. In one aspect of the present invention, a standard full length shuffleboard playfield is cut in half and includes two elongated rectangular planar members which are assembled on location with brackets and leveling bolts to yield a level flat and smooth playing surface at the point of joinder of the two planar members. The shuffleboard playfield includes a base of hard wood and a smooth polymer finish on the top playing surface.

The present two-piece shuffleboard playfield will be used when the length of the playfield of a conventional one-piece shuffleboard game is too long to be carried and/or maneuvered through narrow passageways or up or down stairs and its overall length restricts the installation process such as in basements and upper floor locations. With the unassembled rectangular planar members of the present playfield, the present shuffleboard can be easily delivered through narrow passageways so as to be installed at the desired location. The two elongated planar members of the present shuffleboard playfield are attached to each other through the use of bracket members mounted to the lower surface of each elongated planar member at the terminal end portion thereof or at the point of joinder between the two planar members. When the two planar members are placed in abutting relationship to each other at their point of joinder, the corresponding bracket members mate with each other and can be securely connected to each other through the use of a plurality of spaced apart bolts or other suitable connecting means. An adjustment or leveling bolt is positioned at each respective end of each bracket member. Adjustment of the leveling bolts is made to level the top surface of the elongated planar members at the joint edge, or at their point of joinder. Each side portion of one rectangular planar member adjacent the joint edge can be adjusted up and/or down with respect to the other rectangular planar member by merely adjusting the appropriate leveling bolt. The adjustment bolts are used to raise one corner of the playfield independently of the other corners. Once the playfield is assembled, it is placed in the associated cradle in its playing position.

The present shuffleboard playfield comprises two elongated planar members, each having an upper surface and a lower surface wherein one elongated planar member is coupled to the other elongated planar member in the same plane at a joint edge with bracket members. In a preferred embodiment, two L-shaped brackets, each having a mount panel and a flange portion extending downwardly from one side of the mount panel in substantially perpendicular relationship thereto, are used to attach the two elongated planar members to each other. Each bracket member mounted on the lower surface of the respective first and second elongated planar members at their respective points of joinder includes at least one threaded aperture located adjacent to the joint edge at each respective end thereof for receiving an adjustment or leveling bolt which is engaged therewith to level the upper surfaces of the first and second elongated planar members at the joint edge, or at their point of joinder.

It should be understood that the drawings are not necessarily to scale and that the embodiments illustrated herein are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein. Like numbers utilized throughout the various Figures designate like or similar parts or structure.

DETAILED DESCRIPTION OF THE INVENTION

Figure 1:
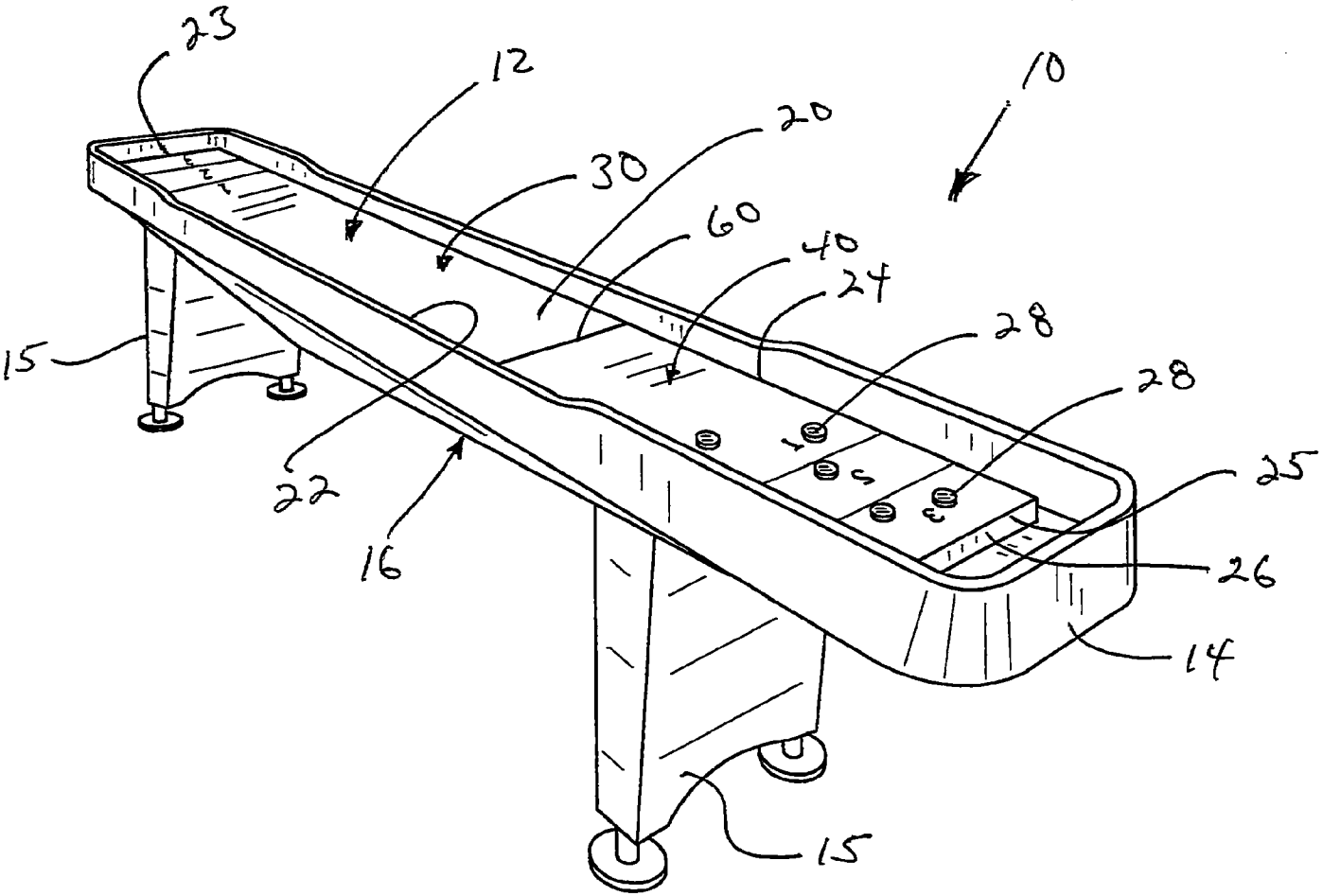
FIG. 1 is a perspective view of the present shuffleboard playfield used with a conventional shuffleboard game table constructed in accordance with the teachings of the present invention.

The present invention is generally embodied in a shuffleboard game. Referring to the drawings, FIGS. 1-4 are various views of one embodiment of a shuffleboard game 10 constructed in accordance with the teachings of the present invention. FIG. 1 illustrates a perspective view of the shuffleboard playfield 12 made in accordance with the present invention and shown mounted on the top recessed area of a cradle 14 which is the cabinet or table structure that the shuffleboard playfield 12 lays in. The shuffleboard game further includes legs 15 which support the cradle 14. The number of legs depends on the size of the playfield 12. The shuffleboard game 10 may optionally include climatic adjusters and leg adjustment bolts (not shown) to level the overall table assembly 16 of the shuffleboard game 10 with respect to the supporting surface.

Referring to FIG. 1, the shuffleboard playfield 12 generally includes an elongated member having a rectangular top side 20 with two elongated longitudinally extending side edges 22 and 24, two transversely extending end portions or edges 23 and 25, and a thickness 26. The rectangular top side 20 includes a series of spaced apart numbers such as the numbers "1", "2", and "3" formed adjacent to each respective end portion 23 and 25, the numbers representing the numbers of points obtained when a puck or disk 28 lands in the numbered zone. In the embodiment illustrated in FIG. 1, the number "3" is located closest to the end portions 23 and 25, the number "2" is located further from the end portions 23 and 25 and the number "1" is located still further from the end portions 23 and 25 with lateral lines formed between the respective numbers identifying the respective scoring zones. The game is played with disk-like pucks 28 which are propelled across the playfield 12 in a sliding motion from one end thereof towards the scoring zones located at the opposite end of the playfield 12. The length of the shuffleboard playfield 12 may vary.

The shuffleboard playfield 12 is typically made of wood with the numbers and lines typically painted or etched into the top surface. In a preferred embodiment, the wood material of the shuffleboard playfield 12 should be a relatively hard wood material such as solid maple and the top surface thereof is covered with a polished polymer layer to improve the sliding surface of the playfield. Those skilled in the art will recognize that other materials can likewise be used without departing from the spirit and scope of the present invention.

Figure 2:
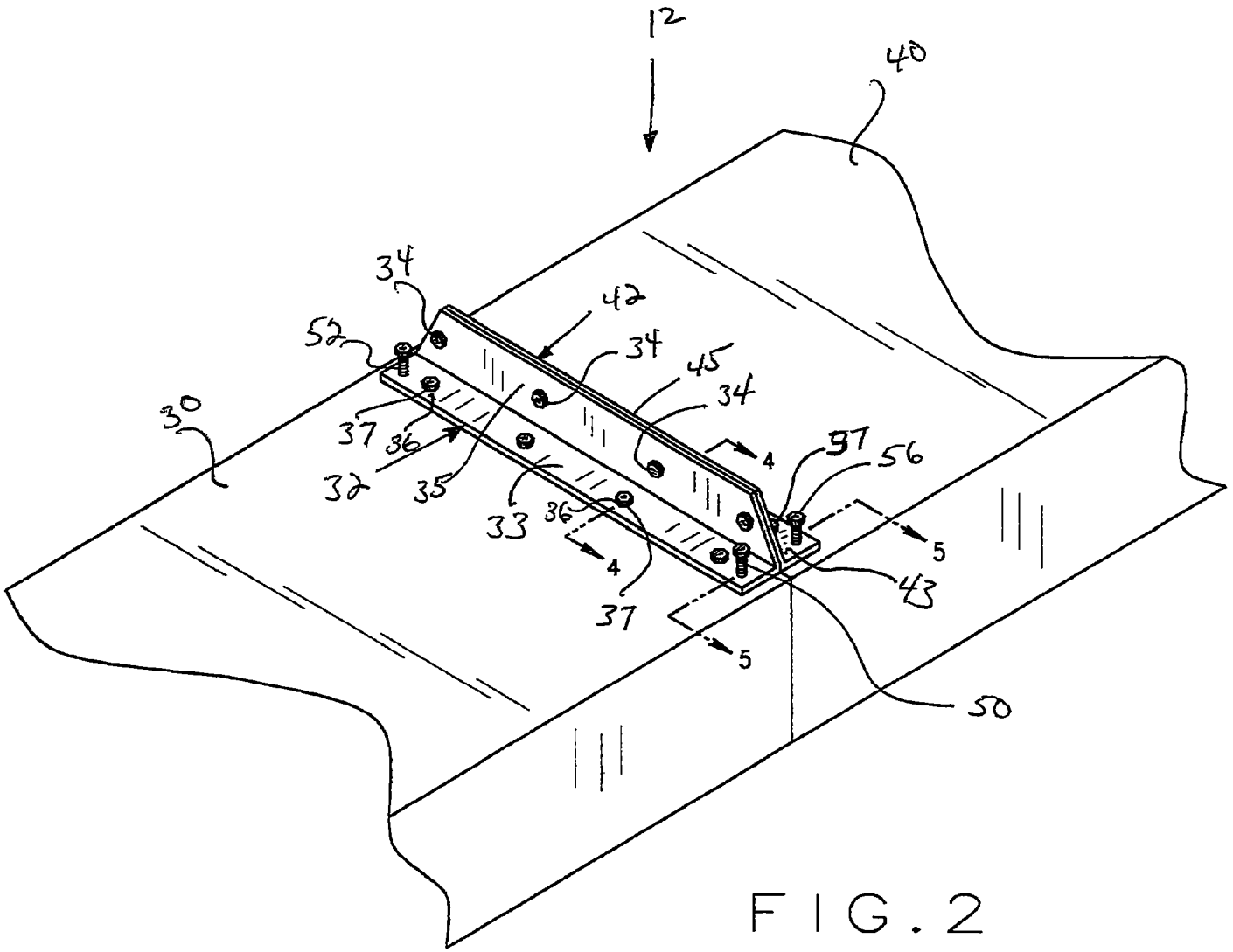
FIG. 2 is a bottom perspective view of the present shuffleboard playfield constructed in accordance with the teachings of the present invention.
Figure 3:
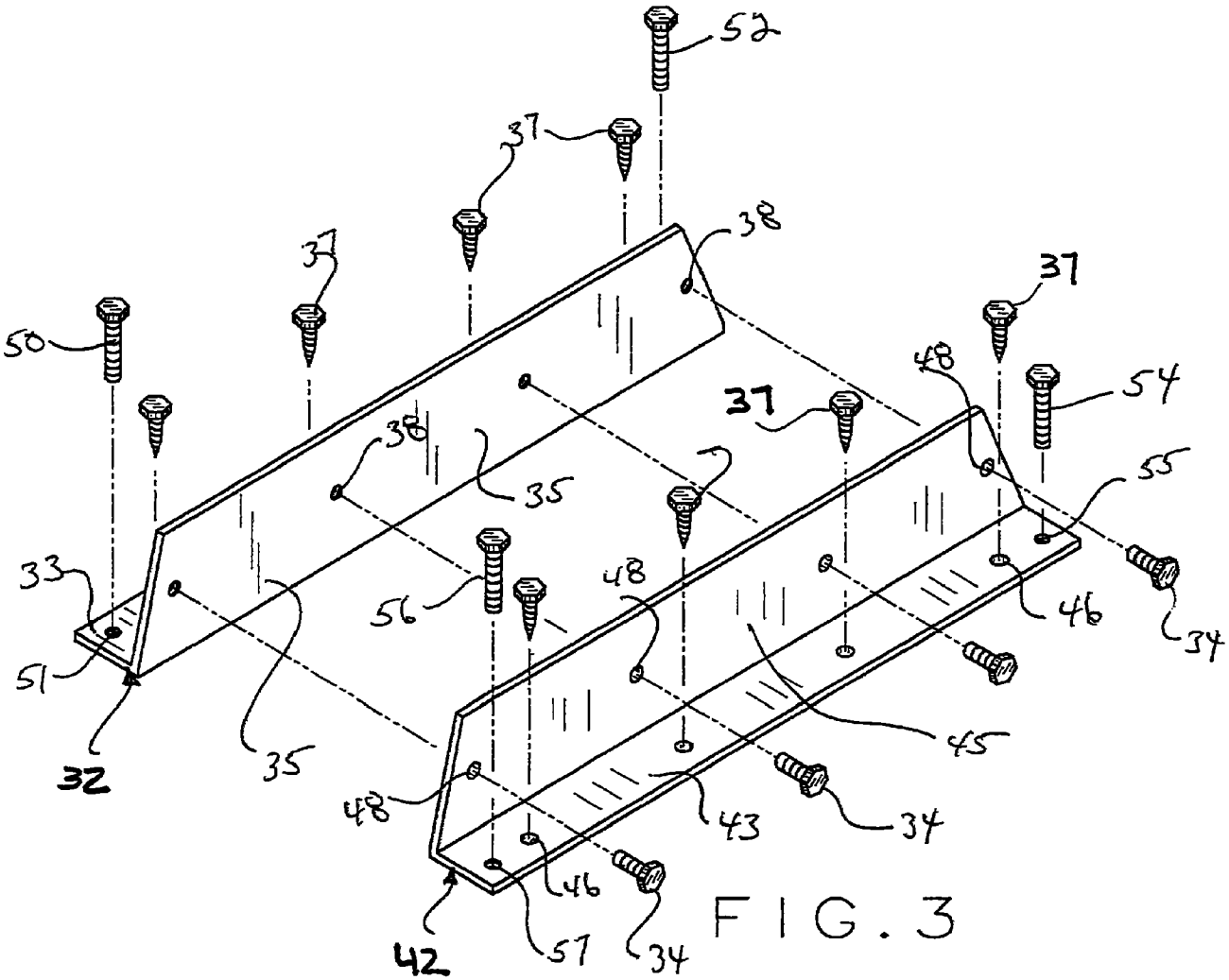
FIG. 3 is an exploded view of the connecting brackets shown in FIG. 2.
Figure 4:
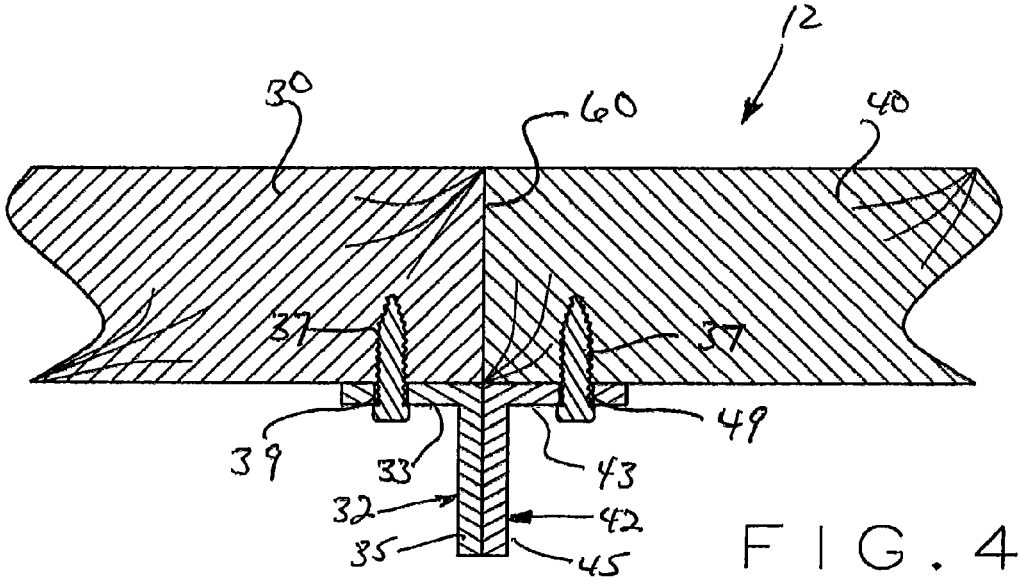
FIG. 4 is a vertical cross-sectional view through the present shuffleboard playfield taken along line 4-4 of FIG. 2.

The shuffleboard playfield 12 made in accordance with the present invention is best illustrated in FIGS. 2-4 and generally includes two rectangular planar members 30 and 40 forming the playfield 12, two bracket members 32 and 42, and at least four adjustment bolts 50, 52, 54 and 56. As used herein, top, bottom, upper, lower and other position terms are used to describe the invention as oriented in FIG. 1.

In one embodiment, the shuffleboard playfield 12 includes two elongated L-shaped brackets 32 and 42 positioned and located at the joint or point of joinder 60 where the two rectangular planar members 30 and 40 meet as shown in FIG. 2. As shown in FIGS. 2-4, the two rectangular planar members 30 and 40 forming the shuffleboard playfield 12 are attached to each other by means of the two L-shaped brackets 32 and 42, each bracket being mounted on its respective rectangular planar members 30 and 40 at or adjacent to the joint or point of joinder 60. Each L-shaped bracket 32 and 42 is mounted to the lower surface of the respective rectangular planar members 30 and 40 at the respective terminal end portion thereof such that when the playfield members 30 and 40 are placed in abutting relationship to each other, the brackets 32 and 42 are likewise placed in abutting relationship with each other and securely connected together at the joint 60 with a plurality of spaced apart clamping bolts 34 or other suitable fastening means as will be hereinafter further explained.

Each bracket member 32 and 42 preferably includes a relatively rigid mount panel 33 and 43 respectively and a respective flange portion 35 and 45 extending downwardly from one side portion of the mount panel 33 and 43. The flange portions 35 and 45 are secured in substantially perpendicular relationship to the mount panel 33 and 43. The brackets 32 and 42 are preferably integrally formed from a rigid material such as steel or another suitable metal material, but they could likewise be formed of any other rigid material. The mount panels 33 and 43 are positioned and located on the underside of the planar playfield members 30 and 40 respectively for secure and rigid attachment thereto through a series of head bolts or other suitable fastening means 37. Spaced about evenly along the full length of each mount panel 33 and 43 are a plurality of apertures 36 and 46 (FIGS. 2 and 3) for receiving the mounting fasteners 37, the fasteners 37 securing the brackets 32 and 42 to the lower surface of the respective rectangular planar members 30 and 40. The rectangular planar members 30 and 40 also include apertures 39 and 49 (FIG. 4) corresponding to each aperture 36 and 46 of the mount panel 33 and 43. The mounting fasteners 37 extend through the apertures 36 and 46 associated with the mount panels 33 and 43 into a corresponding aperture 39 and 49 of the rectangular planar members 30 and 40. Depending upon the type of fastener 37 used, the apertures 36 and 46 and/or the apertures 39 and 49 can be threaded apertures.

The flange portions 35 and 45 are generally shaped to extend downwardly a pre-determined distance (not shown). The flange portion 35 is shaped for mating with flange portion 45 as best illustrated in FIGS. 2-5. The two flange portions 35 and 45 are securely and rigidly attached to each other through a series of clamping bolts or other suitable fasteners 34. Each flange portion 35 and 45 defines a respective spaced apart opening 38 and 48 for receiving the clamping bolts 34 which are inserted through the aligned apertures 38 and 48 thereby locking the bracket members together. In this regard, the apertures 38 or 48 associated with one of the bracket members 32 and 42 are unthreaded and include a smooth inner peripheral wall surface while the apertures 38 or 48 associated with the other bracket member are threaded. Joinder of the flange portions 35 and 45 is accomplished by inserting the bolts 34 first through the smooth apertures 38 or 48 and then through the threaded apertures 38 or 48. The two flange portions 35 and 45 cooperate to align and position the apertures 38 and 48 in registration with each other for receiving the clamping bolts 34, with the diameter of the smooth apertures 38 or 48 being slightly oversized as compared to the diameter of the threaded apertures 38 or 48 to allow for adjustment as will be hereinafter explained. The bracket members 32 and 42 are used in connection with the clamping bolts 34 to attach the shuffleboard playfield members 30 and 40 to each other at the point of joinder 60, the fasteners 34 being predeterminately fastened to the flange portions 35 and 45 of the first and second bracket members 32 and 42 as illustrated in FIG. 2. When the clamping bolts 34 are fully inserted through and engaged with the respective apertures 38 and 48, the two bracket members 32 and 42, and the playfield members 30 and 40, are drawn towards each other and securely fastened to each other. It is recognized and anticipated that the configuration of the bracket members 32 and 42 are subject to wide variations and may be sized and shaped into a variety of different sizes and configurations so as to be compatible with the size and shape of the particular shuffleboard playfield onto which the present bracket members may be mounted without impairing the teachings and practice of the present invention. It is also recognized that the apertures 38 and 48 and the fastening means 34 may likewise be sized and shaped differently and both apertures 38 and 48 may be smooth or threaded so long as the bracket members 32 and 42 are securely fastened together at the point of joinder.

Figure 5A:
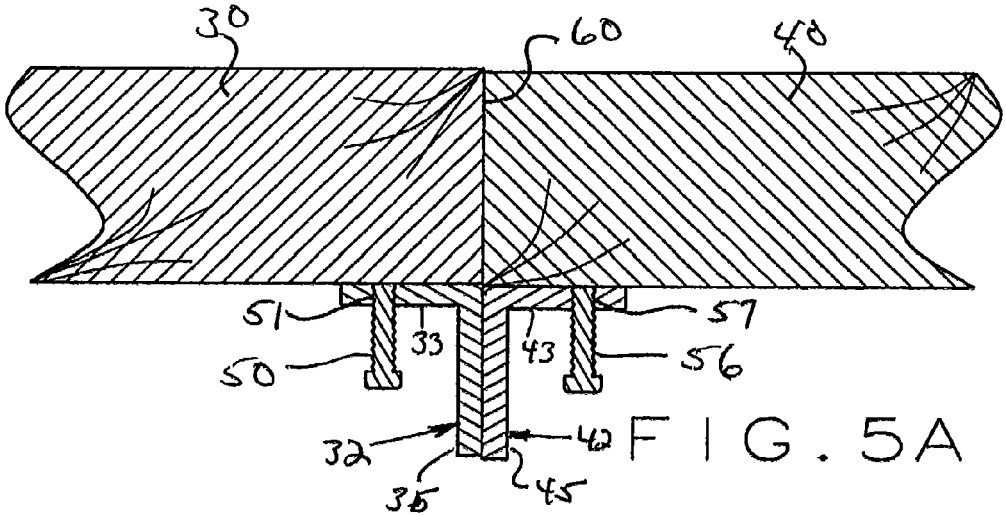
FIG. 5A is a vertical cross-sectional view through the present shuffleboard playfield taken along line 5-5 of FIG. 2, showing the uneven top surface of the assembled shuffleboard playfield.
Figure 5B:
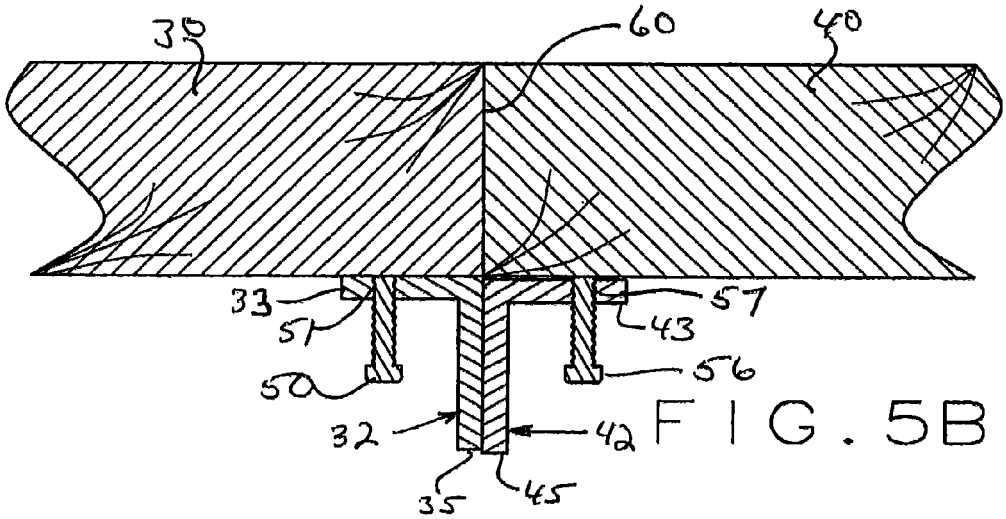
FIG. 5B is a vertical cross-sectional view through the present shuffleboard playfield taken along line 5-5 of FIG. 2 showing the leveling of the top surface of the playfield using a leveling bolt.

Four adjustment or leveling bolts 50, 52, 54 and 56 are located in close vicinity to each respective end portion of each bracket member 32 and 42 at or adjacent to the point or joinder or joint 60 as illustrated in FIGS. 2, 4 and 5, the leveling bolts 50, 52, 54 and 54 engaging the bottom surface of the rectangular planar members 30 and 40 as best illustrated in FIGS. 5A and 5B. Each mount panel 33 and 43 includes a threaded aperture 51, 53, 55 and 57 positioned and located at each end portion thereof as shown in FIGS. 2, 3 and 5, the leveling bolts being threadedly inserted and screwed upwardly through the respective threaded apertures 51, 53, 55 and 57 of the bracket mount panels 33 and 43 for contact with the bottom surface of the rectangular planar members 30 and 40. Unlike the mounting fasteners 37, the rectangular planar members 30 and 40 include no apertures or holes corresponding to the threaded apertures 51, 53, 55 and 57 for receiving the adjustment bolts 50, 52, 54 and 56. Instead, the adjustment or leveling bolts 50, 52, 54 and 56 merely push against the bottom surface of the playfield members 30 and 40 at the outer side edges of each playfield member 30 and 40 at the point of joinder of such members, or at the joint 60. This allows one to adjust the level of the two playfield members 30 and 40 at the point of joinder so as to produce a substantially flat surface at the joint 60 so as not to interfere with or otherwise hinder the sliding motion of the pucks or disks 28 as they slide across the point of joinder 60 as illustrated in FIG. 4.

Adjustment of the two planar playfield members 30 and 40 relative to each other can be accomplished as follows. For example, after installation, as illustrated in FIG. 5A, the top surface of one planar member 30 or 40 could be uneven with or higher than that of the other planar member at the joint 60. If the entire top surface of one of the planar members 30 or 40 is higher than the top surface of the other planar member, merely loosen all of the fastening members 34 joining the flange portions 35 and 45 of the playfield member 30 and 40, push up on the low side of the appropriate playfield member to bring its top surface into alignment with the top surface of the other playfield member, and then re-tighten the clamping bolts or fastening members 34 to lock the playfield members 30 and 40 in place again. Because the apertures 38 or 48 of the smooth holes are slightly oversized as compared to the threaded apertures as previously explained, the oversized apertures allow for adjustment. If, however, only one corner of one of the planar members 30 or 40 is higher than the adjoining corner of the other planar member, adjustment of one of the adjustment bolts 50, 52, 54 and 56 can be made to level the top surface of the rectangular planar members 30 and 40 at or adjacent to the joint 60 at that particular corner. To raise the low corner of the appropriate playfield member merely loosen the fastening member 37 nearest to the selected adjustment bolt and turn and tighten the adjustment bolt. This will cause the top surface of the low corner to rise so as to match the top surface of the adjoining corner of the other playfield member. You can continue this process until the respective playfield corners are aligned.

Each side edge of each rectangular planar member adjacent the joint 60 can be moved up or down independently with respect to the other side edge of the rectangular planar member by simply adjusting the appropriate leveling bolt. The leveling bolts are used individually to raise one corner of the two rectangular planar members independently of the other corners. The pressure of the adjustment bolts 50, 52, 54 and 56 against the lower surface of the appropriate rectangular planar member 30 and 40 will cause the top surface of the rectangular planar members 30 and 40 to be forced upwardly thus effecting leveling of the top surface of the rectangular planar members 30 and 40 at the joint 60. Adjustments are made to level the top surface of the two rectangular planar members 30 and 40 so as to enable the user to accurately level the top surface of the two rectangular planar members at the joint 60 for competitive play.

Once the two rectangular planar members 30 and 40 are delivered to the desired location for installation, they are connected together as previously explained through the use of the bracket members 32 and 42. If the top surfaces of the rectangular planar members 30 and 40 are not even at the point of joinder 60 as discussed above or as illustrated in FIG. 5A, the fastening members 34 or one or more of the adjustment bolts 50, 52, 54 and 56 can be screwed upwardly against the lower surface of the rectangular planar members 30 and 40 to adjust the top surface of the two playfield members 30 and 40 relative to each other.

The ability to raise the rectangular planar members 30 and 40 of the playfield 12 using the bracket members 32 and 42 and the adjustment bolts 50, 52, 54 and 56 has the significant advantage of allowing the installer to make adjustments at the joint 60 while viewing the playfield surface to bring the playfield 12 to a level plane at the joint 60.

It is also recognized that adjustment of the playfield members 30 and 40 at their point of joinder 60 will never yield a seamless joint. However, proper adjustment and alignment of the members 30 and 40 at joint edge 60 can yield a top surface which will not interfere with the sliding motion of the pucks 28 as such pucks pass over the joint 60.

Further, the overall dimensions of the present shuffleboard playfield as well as the specific shape and configuration of the various connecting brackets associated therewith are also subject to wide variations and may be sized and shaped into a wide variety of different sizes and configurations so as to be compatible with the size and shape of the particular shuffleboard table onto which the present structures may be mounted, or to conform with any space limitations associated therewith out impairing the teachings and practice of the present invention.

It is also understood that various modifications may be made to all of the various embodiments without departing from the spirit and scope of the present invention.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present constructions will, however, become apparent to those skilled in the art after considering the present specification and the accompanying drawings. All such changes, modifications, variations and other uses and applications which do not depart from the spirit and scope of the invention are deemed to be covered by the invention and the scope of the present disclosure is not intended to be limited solely to the embodiments shown herein. All structural and functional equivalents to the elements of the various embodiments described throughout this disclosure that are known or later come to be known to those of ordinary skill in the art are expressly incorporated herein by reference and are intended to be encompassed by this disclosure.

What is claimed is:

1. A shuffleboard playfield comprising:

a first elongated planar member having an upper surface and a lower surface;

a second elongated planar member having an upper surface and a lower surface, the second elongated planar member being coupled to the first elongated member in the same plane with each other at a joint edge;

a first bracket member mounted on the lower surface of said first elongated planar member, said first bracket member extending along substantially the entire length of the joint edge, said first bracket member including at least one leveling aperture located adjacent to said joint edge;

a second bracket member mounted on the lower surface of said second elongated planar member, said second bracket member extending along substantially the entire length of the joint edge, said second bracket member including at least one leveling aperture located adjacent to said joint edge;

said first and second bracket members being rigidly attached to each other along substantially the entire length of the joint edge; and a plurality of adjustment bolts, at least one of said adjustment bolts being engaged with said at least one leveling aperture associated with said first bracket member, and at least one of said adjustment bolts being engaged with said at least one leveling aperture associated with said second bracket member, said adjustment bolts being each independently adjustable to push against the lower surface of said first and second planar members respectively so as to level the upper surfaces of the first and second elongated planar members at said joint edge.

2. The shuffleboard playfield of claim 1 wherein said first and second bracket members are L-shaped, each bracket member having a mount panel and a flange portion extending downwardly from one side portion of the mount panel in substantially perpendicular relationship to the mount panel, said flange portions being positioned in abutting relationship to each other along substantially their entire length when attached to each other.

3. The shuffleboard playfield of claim 2 further including a plurality of clamping bolts for attaching the flange portions of said first and second bracket members to each other, said flange portions including a plurality of apertures for receiving each of said clamping bolts, at least some of said plurality of apertures associated with one of said first and second bracket members being unthreaded and including a smooth inner peripheral wall surface and the apertures associated with the other of said first and second bracket members being threaded.

4. The shuffleboard playfield of claim 3 wherein at least some of said plurality of unthreaded apertures are slightly oversized as compared to the diameter of the threaded apertures for allowing adjustment in the vertical direction.

5. A shuffleboard playfield comprising:

a first elongated planar member having an upper surface and a lower surface;

a second elongated planar member having an upper surface and a lower surface, said second elongated planar member being coupled to said first elongated planar member in the same plane with each other at a point of joinder;

a first bracket member mounted on the lower surface of said first elongated planar member, said first bracket member being L-shaped and extending substantially along the entire length of said point of joinder, said first bracket member including a mount panel and a flange portion extending downwardly from one side portion of the mount panel in substantially perpendicular relationship to the mount panel, said mount panel including a leveling aperture positioned and located at each end portion thereof adjacent to said point of joinder;

a second bracket member mounted on the lower surface of said second elongated planar member, said second bracket member being L-shaped and extending substantially along the entire length of said point of joinder, said second bracket member including a mount panel and a flange portion extending downwardly from one side portion of the mount panel in substantially perpendicular relationship to the mount panel, said mount panel including a leveling aperture positioned and located at each end portion thereof adjacent to said point of joinder;

the flange portions of said first and second bracket members being positioned in abutting relationship to each other and being rigidly attached to each other along substantially the entire length of said point of joinder; and a plurality of adjustment means, one of said adjustment means being engaged with each of the leveling apertures associated with the mount panel of said first bracket member, and one of said adjustment means being engaged with each of the leveling apertures associated with the mount panel of said second bracket member, each of said plurality of adjustment means being independently adjustable to push against the lower surface of one of said first and second elongated planar members to level the upper surfaces of the first and second elongated planar members at said point of joinder.

6. The shuffleboard playfield of claim 5 further including a plurality of clamping bolts for attaching the flange portions of said first and second bracket members to each other, said flange portions each including a plurality of apertures for receiving said clamping bolts, the plurality of apertures associated with the flange portion of one of said first and second bracket members being unthreaded and the plurality of apertures associated with the flange portion of the other of said first and second bracket members being threaded.

* * * * *